US008084107B2

(12) United States Patent
Chen

(10) Patent No.: US 8,084,107 B2
(45) Date of Patent: Dec. 27, 2011

(54) INK-JET MEDIA WITH MULTIPLE POROUS MEDIA COATING LAYERS

(75) Inventor: Tienteh Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1371 days.

(21) Appl. No.: 11/053,730

(22) Filed: Feb. 7, 2005

(65) Prior Publication Data

US 2006/0083871 A1 Apr. 20, 2006

Related U.S. Application Data

(60) Provisional application No. 60/620,899, filed on Oct. 20, 2004.

(51) Int. Cl.
*B41M 5/00* (2006.01)

(52) U.S. Cl. ..... 428/32.25; 428/32.27; 428/32.28; 428/32.29; 428/32.3; 428/32.32; 428/32.36; 427/243

(58) Field of Classification Search ..... 428/32.25, 428/32.27, 32.28, 32.29, 32.3, 32.32, 32.36
See application file for complete search history.

(56) References Cited

U.S. PATENT DOCUMENTS

| | | | | |
|---|---|---|---|---|
| 3,886,080 | A | 5/1975 | Schucker et al. | |
| 4,714,769 | A | 12/1987 | De Antoniis et al. | |
| 4,943,375 | A | 7/1990 | Bradshaw et al. | |
| 4,946,557 | A | 8/1990 | Svending | |
| 5,179,213 | A | 1/1993 | Bradshaw et al. | |
| 5,224,972 | A | 7/1993 | Frye et al. | |
| 5,264,275 | A | 11/1993 | Misuda et al. | |
| 5,275,867 | A | 1/1994 | Misuda et al. | |
| 5,368,833 | A | 11/1994 | Johansson et al. | |
| 5,393,892 | A | 2/1995 | Krakowiak et al. | |
| 5,411,787 | A | 5/1995 | Kulkarni et al. | |
| 5,463,178 | A | 10/1995 | Suzuki et al. | |
| 5,547,760 | A | 8/1996 | Tarbet et al. | |
| 5,549,740 | A | 8/1996 | Takahashi et al. | |
| 5,643,414 | A | 7/1997 | Johansson et al. | |
| 5,702,610 | A | 12/1997 | Hagen et al. | |
| 5,702,804 | A | 12/1997 | Malhotra | |
| 5,707,493 | A | 1/1998 | Saastamoinen | |
| 5,804,293 | A | 9/1998 | Nehmsmann et al. | |
| 5,858,280 | A | 1/1999 | Zhang et al. | |
| 5,965,244 | A | 10/1999 | Tang et al. | |
| 5,985,425 | A | 11/1999 | Tomizawa et al. | |
| 6,103,380 | A | 8/2000 | Devonport | |
| 6,110,601 | A | 8/2000 | Shaw-Klein et al. | |
| 6,126,280 | A | 10/2000 | Hashimoto et al. | |
| 6,183,844 | B1 | 2/2001 | Li | |
| 6,228,475 | B1 | 5/2001 | Chu et al. | |
| 6,265,483 | B1 | 7/2001 | Guilard et al. | |
| 6,337,358 | B1 | 1/2002 | Whitehouse et al. | |
| 6,350,519 | B1 | 2/2002 | Devonport | |
| 6,420,039 | B1 | 7/2002 | Field et al. | |
| 6,447,881 | B1 | 9/2002 | Nishida et al. | |
| 6,458,876 | B1 | 10/2002 | Rabasco et al. | |
| 6,502,935 | B1 * | 1/2003 | Barcock et al. | 347/105 |
| 6,565,770 | B1 | 5/2003 | Mayer et al. | |
| 6,652,085 | B2 | 11/2003 | Tsao | |
| 6,670,002 | B1 | 12/2003 | Sekiguchi et al. | |
| 6,685,770 | B2 | 2/2004 | Adachi et al. | |
| 2002/0144626 | A1 | 10/2002 | Schut | |
| 2003/0003277 | A1 * | 1/2003 | Morris et al. | 428/195 |
| 2003/0107637 | A1 * | 6/2003 | Teegarden et al. | 347/105 |
| 2004/0033323 | A1 * | 2/2004 | Gaynor et al. | 428/32.34 |
| 2005/0013946 | A1 * | 1/2005 | Bringley et al. | 428/32.34 |

FOREIGN PATENT DOCUMENTS

| | | |
|---|---|---|
| EP | 0696516 | 2/1996 |
| EP | 0716929 | 5/1996 |
| EP | 0937582 | 8/1999 |
| EP | 1375612 | 1/2004 |
| JP | 2003-01931 | 1/2003 |
| JP | 20031931 | 1/2003 |
| JP | 2003276305 | 9/2003 |
| JP | 2004-58360 | 2/2004 |
| WO | WO97/20216 | 6/1997 |

* cited by examiner

*Primary Examiner* — Betelhem Shewareged

(57) ABSTRACT

The present invention is drawn to a print medium and a method of preparing the same. The print medium can include a media substrate, a porous ink-absorbing layer coated on the media substrate, and a porous ink-receiving layer coated on the porous ink-absorbing layer. The porous ink-absorbing layer can include semi-metal oxide or metal oxide particulates and a first binder, and the porous ink-receiving layer can include organosilane-functionalized semi-metal oxide or metal oxide particulates and a second binder.

35 Claims, No Drawings

INK-JET MEDIA WITH MULTIPLE POROUS MEDIA COATING LAYERS

CLAIM OF PRIORITY

This application claims the benefit of U.S. Provisional Patent Application No. 60/620,899, filed on Oct. 20, 2004, which is incorporated by reference herein in its entirety.

FIELD OF THE INVENTION

The present invention relates generally to the preparation and application of multiple porous media coating layers to media substrates. The present invention also relates to ink-jet media that provides high image quality and fast dry time.

BACKGROUND OF THE INVENTION

Ink-jet inks typically comprise an ink vehicle and a colorant, the latter of which may be a dye or a pigment. Dye-based ink-jet inks used in photographic image printing are almost always water-soluble dyes. As a result, such dye-based ink-jet inks are usually not very water fast, i.e. images tend to shift in hue and edge sharpness is reduced upon exposure to humid conditions. In addition, images created from these water-soluble dye-based ink-jet inks tend to fade over time, such as when exposed to ambient light and/or air. Pigment-based inks on the other hand, allow the creation of images that are vastly improved in humid fastness and image fade resistance. Pigment based images, however, are inferior to dye-based ink-jet inks with respect to the desirable trait of color saturation.

Print media surfaces play a key role in the overall quality of ink-jet produced printed images. Papers used for ink-jet printing have typically included high-quality or wood-free papers designed to have high ink absorptivity. These papers are functionally good for ink-jet printing because the ink-jet inks may be absorbed readily and dry quickly. However, such papers often do not allow for a crisp or sharp image. In order to attain enhanced print quality and image quality as in a photograph, special media has been developed to work with aqueous inks, which can be separated into two broad groups: porous media and swellable media.

With porous media, an ink receiving layer can comprise porous semi-metal oxide or metal oxide particulates (usually silica or alumina) bound together by some polymer binder, and optionally, mordants or ionic binding species, e.g., cationic binding species for use with anionic dyes or anionic binding species for use with cationic dyes such as polymeric cationic mordants. Examples of cationic anionic mordant that can be used include primary amines, secondary amines, tertiary amines, quaternary amines, amidoaminos, pyridines, imines, and imidazoles.

During printing, ink is quickly adsorbed onto the surface which is porous in nature, and if an ionic binding species is present, the colorant can be attracted to the ionic species of opposite charge. This type of media has the advantage of relatively short dry-times, good smearfastness, and often, acceptable water and humidity resistance. Conversely, with swellable media, an ink receiving layer is present that comprises a continuous layer of a swellable polymer that is not physically porous. Upon printing, ink is absorbed as water contacts and swells a polymer matrix of the coating. The colorant, which is typically a dye, can be immobilized inside the continuous layer of the polymer with significantly limited exposure to the outside environment. Advantages of this approach include much better fade resistance (in both light and dark conditions) than is present with porous media. However, swellable media requires a longer dry time, is not typically as crisp in image quality, and exhibits poor smearfastness.

Though both swellable media and porous media each provide unique advantages in the area of ink-jet printing, due to the image crispness and fast dry time achievable from porous media, there is some trending in the direction of the use of porous media. However, with many porous media coatings, there often remains lower color gamut and low gloss and gloss uniformity. These drawbacks have lead to an effort to improve these areas. One approach has been to chemically modify semi-metal oxide or metal oxide particulates of porous coatings with organosilane reagents. Though there has been some success using this approach, with this solution, problems associated with coalescence and slow ink-absorption remain or have been created.

SUMMARY OF THE INVENTION

In accordance with embodiments of the present invention, a print medium can comprise a media substrate, a porous ink-absorbing layer coated on the media substrate, and a porous ink-receiving layer coated on the porous ink-absorbing layer. The porous ink-absorbing layer can include semi-metal oxide or metal oxide particulates and the porous ink-receiving layer can include organosilane-functionalized semi-metal oxide or metal oxide particulates.

In another embodiment, a method of preparing a print medium can comprise steps of applying a porous ink-absorbing layer to a media substrate and applying a porous ink-receiving layer to the porous ink-absorbing layer. The porous ink-absorbing layer can include semi-metal oxide or metal oxide particulates and a first polymeric binder, and the porous ink-receiving layer can include organosilane-functionalized semi-metal oxide or metal oxide particulates and a second polymeric binder.

Additional features and advantages of the invention will be apparent from the following detailed description which illustrates, by way of example, features of the invention.

DETAILED DESCRIPTION OF THE PREFERRED EMBODIMENT(S)

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a colorant" includes reference to one or more of such materials.

"Media substrate" or "substrate" includes any substrate that can be coated with coating compositions (to a porous ink-absorbing layer and a porous ink-receiving layer), and can include papers, overhead projector plastics or films, coated papers such as photobase, fabric, art paper such as water color paper, or the like.

Generally, "porous media" refers to any substantially inorganic particulate-containing coated media having surface voids and/or cavities capable of taking in the ink-jet inks.

Typically, porous media includes a substrate and a porous ink-receiving layer. As ink is printed on the porous media, the ink can fill the voids and the outermost surface can become dry to the touch in a more expedited manner as compared to traditional or swellable media. Common inorganic particulates that can be present in the coatings include semi-metal oxide or metal oxide particulates, such as silica or alumina, for example. Additionally, in accordance with embodiments of the present invention, the coating can be bound together by a polymeric binder, and can optionally include mordants or ionic binding species that are attractive of classes of predetermined dye species. In accordance with embodiments of the present invention, a multilayer structure that includes an ink-receiving layer and an ink-absorption layer are both included.

A "porous ink-absorbing layer" or "ink-absorbing layer" includes semi-metal oxide or metal oxide particulates bound together by a binder, wherein the particulates are not modified with organosilane reagent. Other components, such as formulating agents and/or mordants, can also be present in this layer.

A "porous ink-receiving layer" or "ink-receiving layer" includes organosilane-modified semi-metal oxide or metal oxide particulates bound together by a binder. This layer is typically applied as a topcoat over the ink-absorbing layer. Other components, such as formulating agents and/or mordants, can also be present in this layer.

"Organosilane reagent" or "reagent" includes compositions that comprise a functional moiety (or portion of the reagent that provides desired modified properties to an inorganic particulate surface), which is covalently attached to a silane grouping. The organosilane reagent can become covalently attached or otherwise attracted to the surface of semi-metal oxide or metal oxide particulates. The functional moiety portion of the organosilane reagent can be directly attached to the silane grouping, or can be appropriately spaced from the silane grouping, such as by from 1 to 10 carbon atoms or other known spacer groupings. The silane grouping of the organosilane reagent can be attached to semi-metal oxide or metal oxide particulates of the porous media coating composition through hydroxyl groups, halide groups, or alkoxy groups present on the reagent. Alternatively, in some instances, the organosilane reagent can be merely attracted to the surface of the inorganic particulates.

The term "functional moiety" refers to an active portion of an organosilane reagent that provides a function to the surface of the semi-metal oxide or metal oxide particulates. In accordance with embodiments of the present invention, the functional moiety can be any moiety that is desired for a particular application. In one embodiment, the functional moiety is primary, secondary, tertiary, or quaternary amines. In one embodiment, amines are particularly useful as the functional moiety when the pH of the porous ink-receiving layer and/or the pH of the ink-absorbing layer are less than about 6, and preferably from about 3 to about 5. Such pH values cause the amines to be protonated or cationic, which can attract anionic colorants that may be present in ink-jet inks.

The term "about" when referring to a numerical value or range is intended to encompass the values resulting from experimental error that can occur when taking measurements.

"Binder" or "polymeric binder" includes any substance that can be used to bind semi-metal oxide or metal oxide particulates together. The binder is typically used in an amount that binds the particulates together, but still leaves voids between the particulates for receiving ink or allowing ink to pass therethrough. Typically, binder material that can be used includes polyvinyl alcohol, copolymer of polyvinylalcohol, polyethylene oxide, gelatin, PVP, and/or low glass transition temperature (Tg <20° C.) emulsion polymers, for example. The binder can be present in the porous ink-absorbing layer and/or the porous ink-receiving layer at from about 0.1 wt % to about 40 w %.

As used herein, "liquid vehicle" can include liquid compositions that can be used to carry dyes and/or other substances to a substrate. Liquid vehicles are well known in the art, and a wide variety of ink vehicles may be used in accordance with embodiments of the present invention. Such ink vehicles can include a mixture of a variety of different agents, including without limitation, surfactants, solvents, co-solvents, buffers, biocides, viscosity modifiers, sequestering agents, stabilizing agents, and water.

The term "ink-jet ink" refers to ink-jettable compositions that include a liquid vehicle and a colorant, such as a dye and/or a pigment. Optionally, other ingredients can be carried by the liquid vehicle as well, such as latex polymers, polymer dispersions, UV curable materials, plasticizers, antioxidants, light stabilizers, oxygen scavengers, etc.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc.

With these definitions in mind, the present invention is drawn to a print medium and a method of preparing the same. The print medium can include a media substrate, a porous ink-absorbing layer coated on the media substrate, and a porous ink-receiving layer coated on the porous ink-absorbing layer. The porous ink-absorbing layer can include semi-metal oxide or metal oxide particulates and the porous ink-receiving layer can include organosilane-functionalized semi-metal oxide or metal oxide particulates.

In another embodiment, a method of preparing a print medium can comprise steps of applying a porous ink-absorbing layer to a media substrate and applying a porous ink-receiving layer to the porous ink-absorbing layer. The porous ink-absorbing layer can include semi-metal oxide or metal oxide particulates and a first polymeric binder, and the porous ink-receiving layer can include organosilane-functionalized semi-metal oxide or metal oxide particulates and a second polymeric binder.

Porous Media Coatings

Porous media typically includes a substrate and a porous ink-receiving layer deposited on the substrate. However, in accordance with embodiments of the present invention, at least two porous media coatings are applied to the substrate, namely, porous media coatings that are used to form i) a porous ink-absorbing layer, and ii) a porous ink-receiving layer. As similar components are used to prepare each layer, many of the elements of each layer will be discussed together herein.

The substrate, which supports both the ink-absorbing layer and the ink-receiving layer can be paper, plastic, coated paper, fabric, art paper, or other known substrate used in the ink-jet printing arts. In one embodiment, photobase can be used as the substrate. Photobase is typically a three-layered system comprising a single layer of paper sandwiched by two polymeric layers, such as polyethylene layers.

With respect to the porous ink-absorbing layer and the porous ink-receiving layer, semi-metal oxide or metal oxide particulates, and optionally, polymeric binder, mordants, and/or other porous coating composition agents can be present. A major difference between the particulates of the ink-absorbing layer and the ink-receiving layer is that the particulates of the ink-receiving layer are modified with an organosilane reagent, as will be discussed hereinafter. Aside from the organosilane reagent, both layers can utilize the same type of semi-metal oxide or metal oxide particulates. For example, in each layer, the inorganic semi-metal oxide or metal oxide particulates can be independently selected from silica, alumina, boehmite, silicates (such as aluminum silicate, magnesium silicate, and the like), titania, zirconia, calcium carbonate, clays, or combinations thereof. More commonly, the particulates are alumina or silica, though this is not required. Each of these inorganic particulates can be dispersed throughout a porous coating composition, which can be applied to a media substrate to form either the porous ink-absorbing layer or porous ink-receiving layer.

In order to bind the inorganic particulates in the coating composition together, a polymeric binder can be included. Exemplary polymeric binders that can be used include polyvinyl alcohols including water-soluble copolymers thereof, e.g., copolymers of polyvinyl alcohol and poly(ethylene oxide) or copolymers of polyvinyl alcohol and polyvinylamine; cationic polyvinyl alcohols; acetoacetylated polyvinyl alcohols; polyvinyl acetates; polyvinyl pyrrolidones including copolymers of polyvinyl pyrrolidone and polyvinyl acetate; modified starches including oxidized and etherified starches; water soluble cellulose derivatives including carboxymethyl cellulose, hydroxyethyl cellulose; polyacrylamide including its derivatives and copolymers; casein; gelatin; soybean protein; silyl-modified polyvinyl alcohol; conjugated diene copolymer latexes including maleic anhydride resin and styrene-butadiene copolymer; acrylic polymer latexes including polymers and copolymers of acrylic and methacrylic acids; vinyl polymer latexes including ethylene-vinyl acetate copolymers; functional group-modified latexes including those obtained by modifying the above-mentioned polymers with monomers containing functional groups (e.g. carboxyl, amino, amido, sulfo, etc.); aqueous binders of thermosetting resins including melamine resins, and urea resin; synthetic resin binders including polymethyl methacrylate, polyurethane resin, polyester resin, amide resin, vinyl chloride-vinyl acetate copolymer, polyvinyl butyral, and alkyl resins.

In accordance with embodiments of the present invention, the polymeric binder can be present in either the ink-absorbing layer or the ink-receiving layer at from 0.01 wt % to 40 wt % relative to the total weight of semi-metal oxide or metal oxide particulates. In another embodiment, the binder can be added at from 0.01 wt % to 25 wt %. This being stated, the binder can be present in any functional amount, but typically, less binder is required when using alumina based particulates rather than silica based particulates. For example, in one embodiment, when using polyvinyl alcohol, the level of binder for silica might be from 20 wt % to 25 wt %, whereas for alumina, from 5 wt % to 10 wt % may be more appropriate.

As mentioned, the binder can be present to adequately bind the porous ink-absorbing layer or the porous ink-receiving layer together without resulting in cracking after drying. At the same time, an amount of binder can be present in small enough amounts to maintain the porous nature of the porous ink-absorbing layer or the porous ink-receiving layer. The amount of binder used can contribute to the overall average pore size of a porous media coating layer applied to a media substrate.

In each of the embodiments described herein, as it is the outmost surface, i.e. porous ink-receiving layer, that provides the crispness of the image, and the undercoating, i.e. porous ink-absorbing layer, that can absorb most of the ink-jet ink, it can be desirable that the ink-absorbing layer and the ink-receiving layer be configured appropriately for a given application. For example, in one embodiment, the ink-absorbing layer and the ink-receiving layer can be configured to be relatively similar, aside from the presence of the organosilane reagent in the ink-receiving layer, thus, providing similar absorption throughout the total coating thickness. Alternatively, mordants can be included in both layers, or in one of the layers. For example, including a polymeric amine mordant in the ink-receiving layer can provide improved color gamut, optical density, and coalescence in some embodiments. In another embodiment, aluminum chlorohydrate (ACH) can also be included in one or both of the layers to provide a desired result. In still another embodiment, the ink-absorbing layer can be configured to have a first average pore size, and the porous ink-receiving layer can be configured to have a second average pore size, wherein the first average pore size is larger than the second average pore size. This configuration will facilitate the dual goals of providing a crisp image at the surface (smaller pores), as well as providing the ability to absorb a greater volume of ink deeper within the coating at the ink-absorbing layer (larger pores).

Average pore size can be modulated in at least two ways. First, the semi-metal oxide or metal oxide particulates themselves can be selected with smaller or larger pore sizes, and second, the amount of binder can be varied modulate the size of inter-particulate voids. When determining how much binder to include, considerations other than inter-particulate void size can also be considered. For example, the use of too little of an amount of binder may result in cracking of the coating after drying.

As mentioned previously, there are two different types of porous media coating layers that are used in accordance with embodiments of the present invention, namely a porous ink-absorbing layer and a porous ink-receiving layer. The ink-absorbing layer is typically applied directly to the media substrate, and the ink-receiving layer is applied directly to the ink-absorbing layer. More specifically, the recording media prepared in accordance with embodiments of the present invention can comprise multilayered structure. The ink-receiving layer can comprise a binder and semi-metal oxide or metal oxide particulates that are modified with an organosilane reagent. The binder can be present in an amount to bind the ink-receiving layer and retain smaller voids for accepting ink and/or allowing ink to pass therethrough. The layer beneath the ink-receiving layer, which acts as an absorbing layer, can include a binder and unmodified semi-metal oxide or metal oxide particulates, e.g., amorphous silica. In this layer, the binder can be included in an amount to provide larger interparticulate voids between the particulates, thus allowing for more ink to be collected compared to the ink-receiving layer.

One function of ink-receiving layer is to provide desired image quality like color gamut, optical density, such as black optical density (KOD), coalescence, and gloss. These functions can be provided by two characteristics, namely the organosilane modified semi-metal oxide or metal oxide particulates and the relatively smaller interparticulate spaces between the particulates. A typical thickness of ink-receiving layer can be from about 3 $g/m^2$ to about 15 $g/m^2$, and in other embodiments, from about 3 $g/m^2$ to about 10 $g/m^2$ or from about 3 $g/m^2$ to about 5 $g/m^2$. In one embodiment, the organic moiety-modified semi-metal oxide or metal oxide particulates can be prepared by reacting organosilane coupling agents with silica. In this embodiment, the silica can be fumed, precipitated, or colloidal silica, and the reaction can occur in water or in organic solvents, such as methanol, ethanol, MEK, MIBK or toluene. As these coatings are to be ultimately used with water-based ink-jet inks, the use of water as the solvent for the reaction can be desirable, when possible, due to reduction in steps, cost, and/or environmental concern. Though any organic moiety can be attached the semi-metal oxide or metal oxide, in one embodiment, the organosilane coupling agents can include a primary, secondary, tertiary, and/or quaternary amine.

To exemplify a specific embodiment, a combination of semi-metal oxide or metal oxide particulates in a common ink-receiving layer coating can be desired in some embodiments. For example, the ink-receiving layer can include multiple organosilane reagent types attached to the semi-metal oxide or metal oxide particulates, or alternatively, a combination of aluminumchlorohydrate and an organosilane reagent can be included with the semi-metal oxide or metal oxide particulates. A binder, such as polyvinyl alcohol, can be added to bind the particulates together, but in this particular embodiment, should not be present at more than 30 wt % of the ink-receiving layer, and more preferably, should be present at less than about 25 wt % to maintain a desired porosity of the ink-receiving layer. In one embodiment, the zeta potential of the organosilane reagent treated semi-metal oxide or metal oxide particulates can be at least 30 mV at pH 4.0. The Brunauer-Emmett-Teller (BET) surface area of the semi-metal oxide or metal oxide particulates suitable for use as an ink-receiving layer include those having a surface area greater than about 100 $m^2/g$, and preferably, from about 150 $m^2/g$ to about 300 $m^2/g$.

In one embodiment, a function of ink absorbing layer is to provide fast absorption of inks into the porous media to substantially reduce ink flooding and/or coalescence. A typical thickness of the ink absorption layer can be from about 15 $g/m^2$ to about 40 $g/m^2$, and in other embodiments, from about 20 $g/m^2$ to about 40 $g/m^2$ or from about 25 $g/m^2$ to about 35 $g/m^2$. The ink absorption layer can be comprise of semi-metal oxide or metal oxide particulates, such as fumed silica or aluminum, having a BET surface area less than about 300 $m^2/g$, and preferably from about 100 $m^2/g$ to 300 $m^2/g$. In still another embodiment, the semi-metal oxide or metal oxide particulates of the porous ink-absorbing layer can have a BET surface area less than about 250 $m^2/g$. Further, the ink receiving layer can have a BET surface area less than about 400 $m^2/g$, and preferably from about 200 $m^2/g$ to 400 $m^2/g$. In one embodiment, the semi-metal oxide or metal oxide particulates of the ink-receiving layer can have a lower surface area than is present in the ink-absorbing layer.

Exemplary semi-metal oxide or metal oxide particulates that can be used include Cab-O-Sil LM-150, Cab-O-Sil M-5, Cab-O-Sil MS-75D, Cab-O-Sil H-5, Cab-O-Sil MS-5, Cab-O-Sil PG002, Cab-O-Sil PG022, each from Cabot; and Aerosil 160, Aerosil 200, Aerosil 300 and Aerosil 400, each from Degussa. Cationic silica or aluminum compositions can also be used. Exemplary of cationic silica that can be used can be prepared by treating a fumed silica dispersion with aluminumchlorohydrate (ACH). Alternativley, boehmite can also be used in either the ink-receiving layer or the ink absorbing layer, though in one embodiment, it has been found to be particularly useful in the ink-absorbing layer.

Optionally, the porous ink-receiving layer can also be modified with an ionic binding species or mordant known to interact with a predetermined class of colorants, thereby increasing permanence. Typical mordants that can be included in the coating composition (and thus, included in the porous ink-receiving layer) include hydrophilic, water dispersible, or water soluble polymers having cationic groups (primary amine, secondary amine, tertiary amine, quaternary amine, amidoamino, pyridine, imine, imidazole, or the like). These cationically modified polymers can be compatible with water-soluble or water dispersible binders and have little or no adverse effect on image processing or colors present in the image. Suitable examples of such polymers include, but are not limited to, polyquaternary ammonium salts, cationic polyamines, polyamidins, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin, a polyallylamine; a polyvinylamine; a dicyandiamide-polyalkylene-polyamine condensate; a polyalkylenepolyamine-dicyandiamideammonium condensate; a dicyandiamide-formalin condensate; an addition polymer of epichlorohydrin-dialkylamine; a polymer of diallyldimethylammoniumchloride ("DADMAC"); a copolymer of diallyldimethylammoniumchloride-$SO_2$, polyvinylimidazole, polyvinypyrrolidone; a copolymer of vinylimidazole, polyamidine, chitosan, cationized starch, polymers of vinylbenzyltrimethylqammoniumchloride, (2-methacryloyloxyethyl)trimethyl-ammoniumchloride, and polymers of dimethylaminoethylmethacrylate; or a polyvinylalcohol with a pendant quaternary ammonium salt. Examples of the water-soluble cationic polymers that are available in latex form and are suitable as mordants are TruDot P-2604, P-2606, P-2608, P-2610, P-2630, and P-2850 (available from MeadWestvaco Corp. of Stamford, Conn.), and Rhoplex Primal-26 (available from Rohm and Haas Co. of Philadelphia, Pa.).

Aside from mordants, other optional components that can be present in the porous ink-receiving layer can include anionic surfactants, cationic surfactants, biocides, plasticizers, optical brighteners, viscosity modifiers, leveling agents, UV absorbers, hindered amine stabilizers, anti-ozonants, silane coupling agents, and/or other known additives.

The porous coating compositions of the present invention can be applied to the media substrate to form the ink-absorbing layer or ink-receiving layer by any method known to one skilled in the art, including blade coating, air knife coating, rod coating, wire rod coating, roll coating, slot coating, slide hopper coating, gravure, curtain, or cascade coating. Further, the ink-absorbing layer and/or the ink-receiving layer can be printed on one or both sides of the media substrate.

Surface Modification of Semi-Metal Oxide or Metal Oxide Particulates

In accordance with embodiments of the present invention, organosilane reagents can be used to modify semi-metal oxide and metal oxide particulates. These modified particulates are used in the porous ink-receiving layer in accordance with embodiments of the present invention. To exemplify organosilane reagents that can be used to modify such particulates, Formula 1 is provided, as follows:

Formula 1

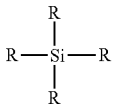

In Formula 1 above, from 0 to 2 of the R groups can be H, —$CH_3$, —$CH_2CH_3$, or —$CH_2CH_2CH_3$; from 1 to 3 of the R groups can be hydroxy, halide, or alkoxy; and from 1 to 3 of the R groups can include a desired functionality, such as amine, quaternary ammonium salts, epoxy, thiol, ureido, isocyanate, poly(ethylene oxide), aldyhyde, imidazole, isothiouronium salts, EDTA, morpholine, sulfonate, carboxylic acid, poly(ethyleneimine), or other functionalities. As colorants present in ink-jet inks are often anionic, amines that are protonated on the surface of the media can be preferred for many ink-jet applications. Additionally in Formula 1, R can also include a spacer group that separates the desired functionality form the silane group, as is known in the art. If halide is present, then Formula 1 can be said to be an organohalosilane reagent. If alkoxy is present, then Formula 1 can be said to be an organoalkoxysilane reagent. Typically, the alkoxy is a methoxy or ethoxy group.

Examples of amine-functionalized organosilane reagents include 3-aminopropyltrimethoxysilane (See Formula 2), 3-aminopropyltriethoxysilane, 3-aminoethylaminopropyltrimethoxysilane (See Formula 3), 3-aminoethylaminopropyltriethoxysilane, 3-aminoethylaminoethylaminopropyltrimethoxysilane (See Formula 5), 3-aminoethylaminoethylaminopropyltriethoxysilane, 3-aminopropylsilsesquioxane, bis-(3-trimethoxysilylpropyl) amine, N-benzyl-N-aminoethyl-3-aminopropyltrimethoxysilane hydrochloride, N-phenyl-3-aminopropyltrimethoxysilane, N-(2-aminoethyl-3-aminopropyltrimethoxysilane, 3-(triethoxysilylpropyl)-diethylenetriamine, poly(ethyleneimine) trimethoxysilane, or the like. Examples of quaternary ammonium salts that can also be used include the quaternary ammonium salts of the amine-functionalized organosilane reagents described above. A specific example of such a quaternary ammonium salt of an organosilane reagent includes trimethoxysilylpropyl-N,N,N-trimethylammonium (See Formula 6) chloride.

Examples of epoxy-functionalized organosilane reagents include 3-glycidoloxypropyltrimethoxysilane (Similar to Formula 8), beta-(3,4-epoxycyclohexyl) ethyltrimethoxysilane, beta-(3,4-epoxycyclohexyl) ethyltriethoxysilane, 5,6-epoxyhexyltrimethoxysilane, epoxypropylheptaisobutyl-T8-silsesquioxane, 3-(glycidoxypropyl)dimethylethoxysilane, (3-glycidoxypropyl)methyldiethoxysilane, (3-glycidoxypropyl)methyldimethoxysilane, or the like.

Another example of a composition that can be used to functionalize the semi-metal oxide or metal oxide particulates of the ink-receiving layer includes heterocyclic aromatic-modified organosilanes (imidazoles).

Formulas 2-13 below depict seven exemplary organosilane reagents that can be used to modify semi-metal oxide or metal oxide particulates in accordance with Formula 1 and embodiments of the present invention, some of which have been described previously:

Formula 2

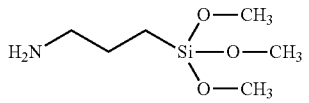

Formula 3

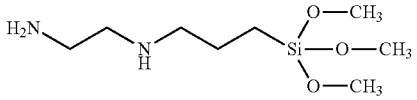

-continued

Formula 4

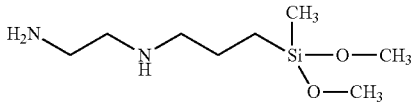

Formula 5

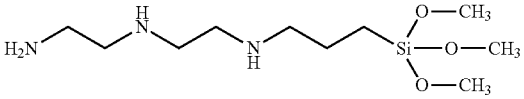

Formula 6

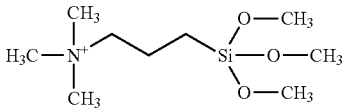

Formula 7

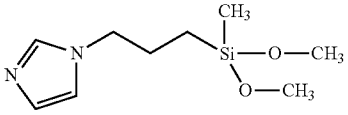

Formula 8

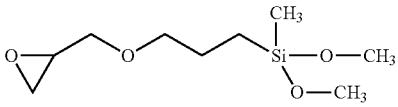

Formula 9

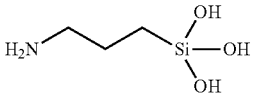

Formula 10

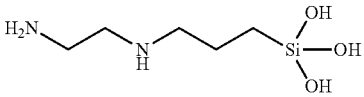

Formula 11

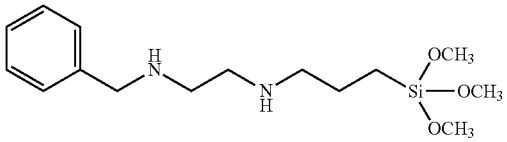

Formula 12

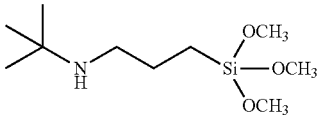

Formula 13

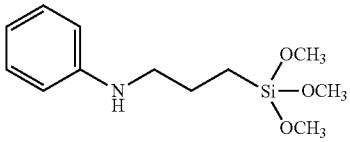

As can be seen by Formulas 2-13, some of the compositions shown are trimethoxysilanes and others are methyldimethoxysilanes. Further, though all of the above examples are methoxysilanes, other reactive silanes can also used, including halosilanes, ethoxysilanes, alkylhalosilanes, alkylalkoxysilanes, or other known reactive silanes, as described generally in Formula 1. Thus, each of the compositions described herein are merely exemplary. There are many organosilane reagents that can be used to modify semi-metal oxide or metal oxide particulates in accordance with embodiments of the present invention.

Though many different types of functional moieties can be attached to the semi-metal oxide or metal oxide particulates for use in the ink-receiving layer and/or the ink-absorbing layer, in one embodiment, amines can be particularly useful for ink-jet applications. To illustrate, when the pH of the porous ink-receiving layer and/or the pH of the ink-absorbing layer are less than about 6, and preferably from about 3 to about 5, the amines will typically be protonated, i.e., greater than 50% protonated. This degree of protonation can be determined by one skilled in the art after considering the pKa for the substance at issue. In this regard, pKa can be defined as the pH at which half of the composition is protonated. Such pH values cause most amines to be protonated, and it is in this state, i.e. cationic, where the amines can act to attract anionic colorants that may be present in ink-jet inks.

The reaction between the organosilane reagents and the semi-metal oxide or metal oxide particulates can be performed in either organic solvents or in an aqueous dispersion. This later method can be desirable for manufacturing purposes, as the preparation of a hydrophilic ink-receiving layer can be carried out with a reduced number of steps when each of the steps are carried out in an aqueous environment.

Ink-Jet Printing Systems

Ink-jet inks that can be used to print on the print media of the present invention include pigment-based and dye-based ink-jet inks. Though any effective amount of colorant can be used, the ink-jet ink can include from 0.1 wt % to 10 wt % of colorant.

With respect to embodiments where dye-based ink-jet inks are used, examples of suitable anionic dyes include a large number of water-soluble acid and direct dyes. Specific examples of anionic dyes include the Direct Yellow 86, Acid Red 249, Direct Blue 199, Direct Black 168, Reactive Black 31, Direct Yellow 157, Reactive Yellow 37, Acid Yellow 23, Reactive Red 180, Acid Red 52, Acid Blue 9, Direct Red 227, Acid Yellow 17, Direct Blue 86, Reactive Red 4, Reactive Red 56, Reactive Red 31, and Direct Yellow 132; Aminyl Brilliant Red F-B (Sumitomo Chemical Co.); the Duasyn line of "salt-free" dyes available from Hoechst; mixtures thereof; and the like. Further examples include Bernacid Red 2BMN, Pontamine Brilliant Bond Blue A, BASF X-34, Pontamine, Food Black 2, Levafix Brilliant Red E-4B (Mobay Chemical), Levafix Brilliant Red E-6BA (Mobay Chemical), Pylam Certified D&C Red #28 (Acid Red 92, Pylam), Direct Brill Pink B Ground Crude (Crompton & Knowles), Cartasol Yellow GTF Presscake (Sandoz, Inc.), Tartrazine Extra Conc. (FD&C Yellow #5, Acid Yellow 23, Sandoz, Inc.), Cartasol Yellow GTF Liquid Special 110 (Sandoz, Inc.), D&C Yellow #10 (Yellow 3, Tricon), Yellow Shade 16948 (Tricon), Basacid Black X34 (BASF), Carta Black 2GT (Sandoz, Inc.), Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company), Levanol Brilliant Red 3BW (Mobay Chemical Company), Levaderm Lemon Yellow (Mobay Chemical Company), Aizen Spilon Yellow C-GNH (Hodagaya Chemical Company), Spirit Fast Yellow 3G, Sirius Supra Yellow GD 167, Cartasol Brilliant Yellow 4GF (Sandoz), Pergasol Yellow CGP (Ciba-Geigy), Orasol Black RL (Ciba-Geigy), Orasol Black RLP (Ciba-Geigy), Savinyl Black RLS (Sandoz), Dermacarbon 2GT (Sandoz), Pyrazol Black BG (ICI Americas), Morfast Black Conc A (Morton-Thiokol), Diazol Black RN Quad (ICI Americas), Orasol Blue GN (Ciba-Geigy), Savinyl Blue GLS (Sandoz, Inc.), Luxol Blue MBSN (Morton-Thiokol), Sevron Blue 5GMF (ICI Americas), and Basacid Blue 750 (BASF); Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, all available from Bayer; Procion Turquoise PA, Procion Turquoise HA, Procion Turquoise Ho5G, Procion Turquoise H-7G, Procion Red MX-5B, Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, all available from ICI Americas; Cibacron Red F-B, Cibacron Black BG, Lanasol Black B, Lanasol Red 5B, Lanasol Red B, and Lanasol Yellow 46, all available from Ciba-Geigy; Baslien Black P-BR, Baslien Yellow EG, Baslien Brilliant Yellow P-3GN, Baslien Yellow M-6GD, Baslien Brilliant Red P-3B, Baslien Scarlet E-2G, Baslien Red E-B, Baslien Red E-7B, Baslien Red M-5B, Baslien Blue E-R, Baslien Brilliant Blue P-3R, Baslien Black P-BR, Baslien Turquoise Blue P-GR, Baslien Turquoise M-2G, Baslien Turquoise E-G, and Baslien Green E-6B, all available from BASF; Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, all available from Sumitomo Chemical Company; Intracron Yellow C-8G, Intracron Red C-8B, Intracron Turquoise Blue GE, Intracron Turquoise HA, and Intracron Black RL, all available from Crompton and Knowles, Dyes and Chemicals Division; Pro-Jet 485 (a copper phthalocyanine); Magenta 377; mixtures thereof, and the like. This list is intended to be merely exemplary, and should not be considered limiting.

Similarly, a wide variety of pigments can be used in pigment-based ink-jet inks, including black pigments, cyan pigments, magenta pigments, yellow pigments, or the like. Examples of black pigments that can be used include carbon pigments. The carbon pigment can be almost any commercially available carbon pigment that provides acceptable optical density and print characteristics. Carbon pigments suitable for use in the present invention include, without limitation, carbon black, graphite, vitreous carbon, charcoal, and combinations thereof. Such carbon pigments can be manufactured by a variety of known method such as a channel method, a contact method, a furnace method, an acetylene method, or a thermal method, and are commercially available from such vendors as Cabot Corporation, Columbian Chemicals Company, Degussa AG, and E.I. DuPont de Nemours and Company. Suitable carbon black pigments include, without limitation, Cabot pigments such as MONARCH 1400, MONARCH 1300, MONARCH 1100, MONARCH 1000, MONARCH 900, MONARCH 880, MONARCH 800, MONARCH 700, CAB-O-JET 200, and CAB-O-JET 300; Columbian pigments such as RAVEN 7000, RAVEN 5750, RAVEN 5250, RAVEN 5000, and RAVEN 3500; Degussa pigments such as Color Black FW 200, RAVEN FW 2, RAVEN FW 2V, RAVEN FW 1, RAVEN FW 18, RAVEN S160, RAVEN FW S170, Special Black 6, Special Black 5, Special Black 4A, Special Black 4, PRINTEX U, PRINTEX 140U, PRINTEX V, and PRINTEX 140V; and TIPURE R-101 available from Dupont. The above list of pigments includes unmodified pigment particulates, small molecule attached pigment particulates, and polymer-dispersed pigment particulates.

A wide variety of colored pigments can also be used with the coated media of the present invention, and as such, the following list is not intended to be limiting. The following color pigments are available from Cabot Corp.: CABO-JET 250C, CABO-JET 260M, and CABO-JET 270Y. The following color pigments are available from BASF Corp.: PALIOGEN Orange, HELIOGEN Blue L 6901F, HELIOGEN Blue NBD 7010, HELIOGEN Blue K 7090, HELIOGEN Blue L 7101F, PALIOGEN Blue L 6470, HELIOGEN Green K 8683, and HELIOGEN Green L 9140. The following pigments are available from Ciba-Geigy Corp.: CHROMOPHTAL Yellow 3G, CHROMOPHTAL Yellow GR, CHROMOPHTAL Yellow 8G, IGRAZIN Yellow 5GT, IGRALITE Rubine 4BL, MONASTRAL Magenta, MONASTRAL Scarlet, MONASTRAL Violet R, MONASTRAL Red B, and MONASTRAL Violet Maroon B. The following pigments are available from Heubach Group: DALAMAR Yellow YT-858-D and HEUCOPHTHAL Blue G XBT-583D. The following pigments are available from Hoechst Specialty Chemicals: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, NOVOPERM Yellow HR, NOVOPERM Yellow FGL, Hansa Brilliant Yellow 10GX, Permanent Yellow G3R-01, HOSTAPERM Yellow H4G, HOSTAPERM Yellow H3G, Hostaperme Orange GR, HOSTAPERM Scarlet GO, and Permanent Rubine F6B. The following pigments are available from Mobay Corp.: QUINDO Magenta, INDOFAST Brilliant Scarlet, QUINDO Red R6700, QUINDO Red R6713, and INDOFAST Violet. The following pigments are available from Sun Chemical Corp.: L74-1357 Yellow, L75-1331 Yellow, and L75-2577 Yellow.

As mentioned, the ink-jet ink compositions of the present invention are typically prepared in an aqueous formulation or liquid vehicle which can include water, cosolvents, surfactants, buffering agents, biocides, sequestering agents, viscosity modifiers, humectants, binders, and/or other known additives. Further, other than the colorant, the liquid vehicle can also carry polymeric binders, latex particulates, and/or other solids.

As described, cosolvents can be included in the ink-jet compositions of the present invention. Suitable cosolvents for use in the present invention include water soluble organic cosolvents, but are not limited to, aliphatic alcohols, aromatic alcohols, diols, glycol ethers, poly(glycol) ethers, lactams, formamides, acetamides, long chain alcohols, ethylene glycol, propylene glycol, diethylene glycols, triethylene glycols, glycerine, dipropylene glycols, glycol butyl ethers, polyethylene glycols, polypropylene glycols, amides, ethers, carboxylic acids, esters, organosulfides, organosulfoxides, sulfones, alcohol derivatives, carbitol, butyl carbitol, cellosolve, ether derivatives, amino alcohols, and ketones. For example, cosolvents can include primary aliphatic alcohols of 30 carbons or less, primary aromatic alcohols of 30 carbons or less, secondary aliphatic alcohols of 30 carbons or less, secondary aromatic alcohols of 30 carbons or less, 1,2-diols of 30 carbons or less, 1,3-diols of 30 carbons or less, 1,5-diols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, lactams, substituted formamides, unsubstituted formamides, substituted acetamides, and unsubstituted acetamides. Specific examples of cosolvents that are preferably employed in the practice of this invention include, but are not limited to, 1,5-pentanediol, 2-pyrrolidone, 2-ethyl-2-hydroxymethyl-1,3-propanediol, diethylene glycol, 3-methoxybutanol, and 1,3-dimethyl-2-imidazolidinone. Cosolvents can be added to reduce the rate of evaporation of water in the ink-jet to minimize clogging or other properties of the ink such as viscosity, pH, surface tension, optical density, and print quality. The cosolvent concentration can range from about 1 wt % to about 40 wt %, and in one embodiment is from about 2 wt % to about 30 wt %. Multiple cosolvents can also be used, as is known in the art.

Various buffering agents or pH adjusting agents can also be optionally used in the ink-jet ink compositions of the present invention. Typical buffering agents include such pH control solutions as hydroxides of alkali metals and amines, such as lithium hydroxide, sodium hydroxide, potassium hydroxide; citric acid; amines such as triethanolamine, diethanolamine, and dimethylethanolamine; hydrochloric acid; and other basic or acidic components which do not substantially interfere with the bleed control or optical density characteristics of the present invention. If used, buffering agents typically comprise less than about 10 wt % of the ink-jet ink composition.

In another aspect of the present invention, various biocides can be used to inhibit growth of undesirable microorganisms. Several non-limiting examples of suitable biocides include benzoate salts, sorbate salts, commercial products such as NUOSEPT (Nudex, Inc., a division of Huls America), UCARCIDE (Union Carbide), VANCIDE (RT Vanderbilt Co.), and PROXEL (ICI Americas) and other known biocides. Typically, such biocides comprise less than about 5 wt % of the ink-jet ink composition and often from about 0.1 wt % to about 0.25 wt %.

In an additional aspect of the present invention, binders can be included in the liquid vehicle of the ink-jet ink which acts to secure the colorants on the substrate. Binders suitable for use in the present invention typically have a molecular weight of from about 1000 Mw to about 3,000,000 Mw. Non-limiting examples include polyester, polyester-melanine, styrene-acrylic acid copolymers, styrene-acrylic acid-alkyl acrylate copolymers, styrene-maleic acid copolymers, styrene-maleic acid-alkyl acrylate copolymers, styrene-methacrylic acid copolymers, styrene-methacrylic acid-alkyl acrylate copolymers, styrene-maleic half ester copolymers, vinyl naphthalene-acrylic acid copolymers, vinyl naphthalene-maleic acid copolymers, and salts thereof.

If surfactants are present, then typical water-soluble surfactants such as TRITONS™ (including ethoxylated octylphenols), IGEPALS™ (including alkyl phenoxypoly (ethleneoxy) ethanols), SILWETS™ (including silicone glycol copolymers including polyalkylene oxide-modified polydimethylsiloxanes, SURFYNOLS™ (including ethoxlyated tetramethyl decyndiols), TERGITOLS™ (including ethoxylated trimethylnonanols), BRIJS™ (including polyoxyethylene ethers), PLURONICS™ (including ethylene oxide/propylene oxide copolymers), FLUORADS™ and ZONYLS™ (including fluorosurfactants), and NEODOLS™ (including nonionic ethoxylated surfactants). Other surfactants or wetting agents that can be used include Wetting Olin10G, alkyl polyethylene oxides, alkyl phenyl polyethylene oxides, polyethylene oxide (PEO) block copolymers, acetylenic PEO, PEO esters, PEO amines, PEO amides, and dimethicone copolyols. Any of these surfactants, or combination of these surfactants or other surfactants, can be present at from 0.01 wt % to about 10 wt % of the ink-jet ink composition.

EXAMPLES

The following examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. The appended claims are intended to cover such modifications and arrangements. Thus, while the present invention has been described above with particularity, the following examples provide further detail in connection with what are presently deemed to be the most practical and preferred embodiments of the invention.

Example 1

Preparation of Single-Layered Organosilane-Modified Porous Media

A sheet of 9 mil photobase media was coated at 30 g/m$^2$ with a coating composition including the following ingredients: 100 parts by weight Cab-O-Sil PG022 (Surface area of 200 m$^2$/g) having 5 w % of 3-aminopropyltrimethoxysilane covalently attached thereto; and 25 parts by weight polyvinyl alcohol binder.

Example 2

Preparation of Single-Layered Organosilane-Modified Porous Media

A sheet of 9 mil photobase media was coated at 30 g/m$^2$ with a coating composition including the following ingredients: 100 parts by weight Cab-O-Sil PG022 (Surface area of 200 m$^2$/g) having 5 w % of trimethoxysilylpropyl-N,N,N-trimethylammonium covalently attached thereto; and 25 parts by weight polyvinyl alcohol binder.

Example 3

Preparation of Double-Layered Organosilane-Modified Porous Media

A sheet of 9 mil photobase media was coated at 27 g/m$^2$ with a coating composition including the following ingredients: 100 parts by weight of Cab-O-Sil M-5 treated with 10 w % of ACH (Surface area of 200 m$^2$/g); and 25 parts by weight polyvinyl alcohol binder. This formed a porous ink-absorbing layer, which included inorganic modified silica. The ink-absorbing layer was allowed to dry. A second layer, which was the porous ink-receiving layer, was coated directly on the previously applied porous ink-absorbing layer at coating thickness of 5 g/m$^2$. The coating composition for the second layer included the following ingredients: 100 parts by weight Cab-O-Sil PG022 (Surface area of 200 m$^2$/g) having 5 w % of 3-aminopropyltrimethoxysilane covalently attached thereto; and 20 parts by weight polyvinyl alcohol binder.

Example 4

Preparation of Double-Layered Organosilane-Modified Porous Media

A sheet of 9 mil photobase media was coated at 27 g/m$^2$ with a coating composition including the following ingredients: 100 parts by weight of Cab-O-Sil M-5 treated with 10 w % of ACH (Surface area of 200 m$^2$/g); and 25 parts by weight polyvinyl alcohol binder. This formed a porous ink-absorbing layer, which included inorganic modified silica. This first layer was allowed to dry. A second layer, which would act as a porous ink-receiving layer, was coated directly on the previously applied porous ink-absorbing layer at coating thickness of 10 g/m$^2$. The coating composition for the second layer included the following ingredients: 100 parts by weight Cab-O-Sil PG022 (Surface area of 200 m$^2$/g) having 5 w % of 3-aminopropyltrimethoxysilane covalently attached thereto; and 20 parts by weight polyvinyl alcohol binder.

Example 5

Preparation of Double-Layered Organosilane-Modified Porous Media

A sheet of 9 mil photobase media was coated at 27 g/m$^2$ with a coating composition including the following ingredients: 100 parts by weight of Cab-O-Sil M-5 treated with 10 w % of ACH (Surface area of 200 m$^2$/g); and 25 parts by weight polyvinyl alcohol binder. This formed a porous ink-absorbing layer, which included inorganic modified silica. This first layer was allowed to dry. A second layer, which would act as a porous ink-receiving layer, was coated directly on the previously applied porous ink-absorbing layer at coating thickness of 5 g/m$^2$. The coating composition for the second layer included the following ingredients: 100 parts by weight Cab-O-Sil PG022 (Surface area of 200 m$^2$/g) having 5 w % of trimethoxysilylpropyl-N,N,N-trimethylammonium covalently attached thereto; and 20 parts by weight polyvinyl alcohol binder.

Example 6

Preparation of Double-Layered Organosilane-Modified Porous Media

A sheet of 9 mil photobase media was coated at 27 g/m$^2$ with a coating composition including the following ingredients: 100 parts by weight of Cab-O-Sil M-5 treated with 10 w % of ACH (Surface area of 200 m$^2$/g); and 25 parts by weight polyvinyl alcohol binder. This formed a porous ink-absorbing layer, which included inorganic modified silica. This first layer was allowed to dry. A second layer, which would act as a porous ink-receiving layer, was coated directly on the previously applied porous ink-absorbing layer at coating thickness of 5 g/m$^2$. The coating composition for the second layer included the following ingredients: 100 parts by weight Cab-O-Sil PG022 (Surface area of 200 m$^2$/g) having 10 w % of trimethoxysilylpropyl-N,N,N-trimethylammonium covalently attached thereto; and 20 parts by weight polyvinyl alcohol binder.

Example 7

Preparation of Double-Layered Organosilane-Modified Porous Media

A sheet of 9 mil photobase media was coated at 27 g/m$^2$ with a coating composition including the following ingredients: 100 parts by weight of Cab-O-Sil LM-150 treated with 10 w % of ACH (Surface area of 160 m$^2$/g); and 22 parts by weight polyvinyl alcohol binder. This formed a porous ink-absorbing layer, which included inorganic modified silica. This first layer was allowed to dry. A second layer, which would act as a porous ink-receiving layer, was coated directly on the previously applied porous ink-absorbing layer at coating thickness of 5 g/m$^2$. The coating composition for the second layer included the following ingredients: 100 parts by weight Cab-O-Sil MS-75D (Surface area of 250 m$^2$/g) having 5 w % of trimethoxysilylpropyl-N,N,N-trimethylammonium covalently attached thereto; and 20 parts by weight polyvinyl alcohol binder.

Example 8

Preparation of Double-Layered Organosilane-Modified Porous Media

A sheet of 9 mil photobase media was coated at 27 g/m$^2$ with a coating composition including the following ingredients: 100 parts by weight of Cab-O-Sil M-5 treated with 10 w % of ACH (Surface area of 200 $m^2/g$); and 25 parts by weight polyvinyl alcohol binder. This formed a porous ink-absorbing layer, which included inorganic modified silica. This first layer was allowed to dry. A second layer, which would act as a porous ink-receiving layer, was coated directly on the previously applied porous ink-absorbing layer at coating thickness of 5 $g/m^2$. The coating composition for the second layer included the following ingredients: 100 parts by weight Cab-O-Sil H-7 (Surface area of 300 $m^2/g$) having 5 w % of trimethoxysilylpropyl-N,N,N-trimethylammonium covalently attached thereto; and 20 parts by weight polyvinyl alcohol binder.

Example 9

Comparison of Single-Layered Media with Double-Layered Media

Each of the media samples prepared in Examples 1-6 were printed on using a black state of the art ink-jet ink, and comparisons were evaluated in the areas of color gamut (C*L*a*b*), black optical density (KOD), and coalescence. In Table 1, the 3-aminopropyltrimethoxysilane-modified single layer media of Example 1 is compared to the 3-aminopropyltrimethoxysilane-modified double-layered media of Examples 3 and 4 prepared in accordance with embodiments of the present invention. In Table 2, the trimethoxysilylpropyl-N,N,N-trimethylammonium-modified single-layered media of Example 2 is compared to the trimethoxysilylpropyl-N,N,N-trimethylammonium-modified double layered media of Examples 5 and 6 prepared in accordance with embodiments of the present invention.

TABLE 1

| Media Sample | C*L*a*b* | KOD | Coalescence |
|---|---|---|---|
| Example 1 | 349872 | 1.62 | 4.5 |
| Example 3 | 359962 | 1.60 | 5 |
| Example 4 | 350140 | 1.64 | 5 |

TABLE 2

| Media Sample | C*L*a*b* | KOD | Coalescence |
|---|---|---|---|
| Example 2 | 330737 | 1.59 | 4.5 |
| Example 5 | 357168 | 1.64 | 5 |
| Example 6 | 360988 | 1.66 | 5 |

As can be seen from Tables 1 and 2, the ink-jet media having the double-layered coatings prepared in accordance with embodiments of the present invention almost universally outperformed single-layered organosilane reagent modified porous media. The only exception is the KOD of Example 3, which was slightly lower than the KOD of Example 1. However, this difference is within a margin that would be substantially imperceptible.

Example 10

Preparation of Double-Layered Organosilane-Modified Porous Media Including Polymeric Amine Mordant The double-layered porous media sample prepared in Examples 3 was re-prepared, except that to the second layer formulation was also added a polymeric amine mordant (5 parts by weight Catiofast CS, from BASF).

Example 11

Comparison of Double-Layered Media with and without Mordant

The media samples prepared in accordance with Example 3 and Example 8 were each printed on using a black state of the art ink-jet ink, and comparisons were evaluated in the areas of color gamut (C*L*a*b*), black optical density (KOD), and coalescence, as shown in Table 3 below.

TABLE 3

| Media Sample | C*L*a*b* | KOD | Coalescence |
|---|---|---|---|
| Example 3 | 359962 | 1.60 | 5 |
| Example 10 | 373858 | 1.72 | 5 |

As can be seen by Table 3, the color gamut, black optical density, and coalescence was further improved by the addition of a polymeric amine mordant in the porous ink-receiving layer.

Similar tests were also conducted using different polymeric amine mordants, different amounts of polymeric amine mordant, and in different porous ink-receiving layer formulations, e.g., such as the Examples 4-6 formulations. These additional tests also resulted in similar general improvements in color gamut, black optical density, and coalescence across the board.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A print medium, comprising:

a) a media substrate;

b) a porous ink-absorbing layer coated on the media substrate, said porous ink-absorbing layer including semi-metal oxide or metal oxide particulates and a first binder; and c) a porous ink-receiving layer coated on the porous ink-absorbing layer, said porous ink-receiving layer including organosilane-functionalized semi-metal oxide or metal oxide particulates and a second binder;

wherein the first binder is present in an amount to provide larger interparticulate voids in the porous absorbing layer as compared to the porous ink-receiving layer, and wherein the organosilane-functionalized semi-metal oxide or metal oxide particulates of the porous ink-receiving layer has the same BET surface area as the semi-metal oxide or metal oxide particulates of the porous ink-absorbing layer before functionalizing with the organosilane.

2. A print medium as in claim 1, wherein the first polymeric binder and the second polymeric binder are each present in the porous ink-absorbing layer and the porous ink-receiving layer, respectively, at from about 0.01 wt % to 40 wt %.

3. A print medium as in claim 1, wherein the first polymeric binder and the second polymeric binder are of the same material.

4. A print medium as in claim 2, wherein the first polymeric binder and the second polymeric binder are independently selected from the group consisting of polyvinyl alcohols; water-soluble copolymers of polyvinyl alcohols including copolymer of polyvinyl alcohol and poly(ethylene oxide) and copolymer of polyvinyl alcohol and polyvinyl amine; cationic polyvinyl alcohols; acetoacetylated polyvinyl alcohols; polyvinyl acetate, polyvinyl pyrrolidone; modified starches; water soluble cellulose derivatives; polyacrylamides; casein; gelatin; soybean protein; silyl-modified polyvinyl alcohol; conjugated diene copolymer latexes; acrylic polymer latexes; vinyl polymer latexes; functional group-modified latexes; aqueous binders of thermosetting resins; synthetic resin; and combinations thereof.

5. A print medium as in claim 1, wherein both i) the semi-metal oxide or metal oxide particulates, and ii) the organosilane-functionalized semi-metal oxide or metal oxide particulates, include particulates independently selected from the group consisting of silica, alumina, boehmite, silicate, titania, zirconia, calcium carbonate, clays, and combinations thereof.

6. A print medium as in claim 1, wherein the organosilane-functionalized semi-metal oxide or metal oxide particulates include amine-functionalized particulates.

7. A print medium as in claim 6, wherein the amine-functionalized particulates are selected from the group consisting of 3-aminopropyltrimethoxysilane, 3-aminopropyltriethoxysilane, 3-amino ethylaminopropyltrimethoxysilane, 3-aminoethylaminopropyltriethoxysilane, 3-aminoethylaminoethylaminopropyltrimethoxysilane, 3-aminoethylaminoethylaminopropyltriethoxysilane, 3-aminopropylsilsesquioxane, bis-(3-trimethoxysilylpropyl) amine, N-benzyl-N-aminoethyl-3-aminopropyltrimethoxysilane hydrochloride, N-phenyl-3-aminopropyltrimethoxysilane, N-(2-aminoethyl-3-aminopropyltrimethoxysilane, 3-(triethoxysilylpropyl)-diethylenetriamine, poly(ethyleneimine) trimethoxysilane, and quaternary ammonium salts thereof.

8. A print medium as in claim 6, wherein the amine-functionalized particulates include a quaternary ammonium salt of trimethoxysilylpropyl-N,N,N-trimethylammonium chloride.

9. A print medium as in claim 1, wherein at least one of the porous ink-absorbing layer and the porous ink-receiving layer includes a polymeric cationic mordant.

10. A print medium as in claim 9, wherein the polymeric cationic mordant is selected from the group consisting of primary amine, secondary amine, tertiary amine, quaternary amine, amidoamino, pyridine, imine, and imidazole.

11. A print medium as in claim 1, wherein the porous ink-absorbing layer has a first average pore size, and the porous ink-receiving layer has a second average pore size, wherein the first average pore size is equal to or larger than the second average pore size.

12. A print medium as in claim 1, wherein the thickness of the porous ink-absorbing layer is from 15 $g/m^2$ to 40 $g/m^2$.

13. A print medium as in claim 1, wherein the thickness of the porous ink-receiving layer is from 3 $g/m^2$ to 15 $g/m^2$.

14. A print medium as in claim 1, wherein the semi-metal oxide or metal oxide particulates of the porous ink-absorbing layer have a BET surface area of from 100 $m^2/g$ to 300 $m^2/g$.

15. A print medium as in claim 1, wherein the organosilane-functionalized semi-metal oxide or metal oxide particulates of the porous ink-receiving layer have a BET surface area of from 200 $m^2/g$ to 400 $m^2/g$.

16. A print medium as in claim 1, wherein the porous ink-receiving layer has been printed on with a dye-based ink jet ink.

17. A print medium as in claim 1, wherein the porous ink-receiving layer has been printed on with a pigment-based ink jet ink.

18. A print medium as in claim 1, wherein the ink-receiving layer has a pH less than about 6, and wherein the organosilane-functionalized semi-metal oxide or metal oxide particulates include an amine, said amine being more than 30% protonated at the ink-receiving layer.

19. A print medium as in claim 18, wherein the pH is from 2 to 5.

20. A method of preparing the print medium as in claim 1, comprising: a) applying the porous ink-absorbing layer to the media substrate; and b) applying the porous ink-receiving layer to the porous ink-absorbing layer.

21. A method as in claim 20, wherein the first polymeric binder and the second polymeric binder are of the same material.

22. A method as in claim 20, wherein the first polymeric binder and the second polymeric binder are independently selected from the group consisting of polyvinyl alcohols; water-soluble copolymers of polyvinyl alcohols including copolymer of polyvinyl alcohol and poly(ethylene oxide) and copolymer of polyvinyl alcohol and polyvinyl amine; cationic polyvinyl alcohols; acetoacetylated polyvinyl alcohols; polyvinyl acetate, polyvinyl pyrrolidone; modified starches; water soluble cellulose derivatives; polyacrylamides; casein; gelatin; soybean protein; silyl-modified polyvinyl alcohol; conjugated diene copolymer latexes; acrylic polymer latexes; vinyl polymer latexes; functional group-modified latexes; aqueous binders of thermosetting resins; synthetic resin; and combinations thereof.

23. A method as in claim 20, wherein both i) the semi-metal oxide or metal oxide particulates, and the organosilane-functionalized semi-metal oxide or metal oxide particulates, each include particulates independently selected from the group consisting of silica, alumina, boehmite, silicate, titania, zirconia, calcium carbonate, clays, and combinations thereof.

24. A method as in claim 20, wherein the organosilane-functionalized semi-metal oxide or metal oxide particulates include amine-functionalized particulates.

25. A method as in claim 24, wherein the amine-functionalized particulates are selected from the group consisting of 3-aminopropyltrimethoxysilane, 3-aminopropyltriethoxysilane, 3-amino ethylaminopropyltrimethoxysilane, 3-aminoethylaminopropyltriethoxysilane, 3-aminoethylaminoethylaminopropyltrimethoxysilane, 3-aminoethylaminoethylaminopropyltriethoxysilane, 3-aminopropylsilsesquioxane, bis-(3-trimethoxysilylpropyl) amine, N-benzyl-N-aminoethyl-3-aminopropyltrimethoxysilane hydrochloride, N-phenyl-3-aminopropyltrimethoxysilane, N-(2-aminoethyl-3-aminopropyltrimethoxysilane, 3-(triethoxysilylpropyl)-diethylenetriamine, poly(ethyleneimine) trimethoxysilane, and quaternary ammonium salts thereof.

26. A method as in claim 24, wherein the amine-functionalized particulates include a quaternary ammonium salt of trimethoxysilylpropyl-N,N,N-trimethylammonium chloride.

27. A method as in claim 20, wherein at least one of the porous ink-absorbing layer and the porous ink-receiving layer includes a polymeric cationic mordant.

28. A method as in claim 27, wherein the polymeric cationic mordant is selected from the group consisting of primary amine, secondary amine, tertiary amine, quaternary amine, amidoamino, pyridine, imine, and imidazole.

29. A method as in claim 20, wherein the porous ink-absorbing layer is applied having a first average pore size, and the porous ink-receiving layer is applied having a second average pore size, wherein the first average pore size is larger than the second average pore size.

30. A method as in claim 20, wherein the step of applying the porous ink-absorbing layer includes applying the porous ink-absorbing layer at a thickness from 15 $g/m^2$ to 50 $g/m^2$.

31. A method as in claim 20, wherein the step of applying the porous ink-receiving layer includes applying the porous ink-receiving layer at a thickness from 3 $g/m^2$ to 15 $g/m^2$.

32. A method as in claim 20, wherein the semi-metal oxide or metal oxide particulates of the porous ink-absorbing layer have a BET surface area of from 100 $m^2/g$ to 300 $m^2/g$.

33. A method as in claim 20, wherein the semi-metal oxide or metal oxide particulates of the porous ink-receiving layer have a BET surface area of from 200 $m^2/g$ to 400 $m^2/g$.

34. A method as in claim 20, wherein the ink-receiving layer has a pH less than about 6, and wherein the organosilane-functionalized semi-metal oxide or metal oxide particulates include an amine, said amine being more than 30% protonated at the ink-receiving layer.

35. A method as in claim 34, wherein the pH is from 2 to 5.

* * * * *